US010017339B2

(12) United States Patent
Woo

(10) Patent No.: US 10,017,339 B2
(45) Date of Patent: Jul. 10, 2018

(54) PAPER FEEDING APPARATUS AND IMAGE FORMING APPARATUS ADOPTING THE SAME

(71) Applicant: S-PRINTING SOLUTION CO., LTD., Suwon-si, Gyeonggi-do (KR)

(72) Inventor: Ji-hoon Woo, Hwaseong (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/160,176

(22) Filed: May 20, 2016

(65) Prior Publication Data

US 2017/0017185 A1 Jan. 19, 2017

(30) Foreign Application Priority Data

Jul. 15, 2015 (KR) ..... 10-2015-0100519

(51) Int. Cl.
*B65H 3/06* (2006.01)
*G03G 15/00* (2006.01)

(52) U.S. Cl.
CPC ..... *B65H 3/0684* (2013.01); *B65H 3/0669* (2013.01); *G03G 15/6511* (2013.01); *G03G 15/6529* (2013.01); *B65H 2405/324* (2013.01)

(58) Field of Classification Search
CPC ..... B65H 3/0684; B65H 2405/324; B65H 3/0669
See application file for complete search history.

(56) References Cited

U.S. PATENT DOCUMENTS 5,462,267 A * 10/1995 Hori ..... B65H 3/0669 271/10.04
5,501,444 A * 3/1996 Yukimachi ..... B65H 1/14 271/10.11
5,893,555 A * 4/1999 Kawada ..... B65H 1/14 271/117
7,099,619 B2 8/2006 Choi
7,296,790 B2 * 11/2007 Kim ..... B65H 3/0684 271/114

(Continued)

FOREIGN PATENT DOCUMENTS

JP 3-197979 8/1991
JP 2003-118862 4/2003
JP 2007-254138 4/2007

OTHER PUBLICATIONS

Extended European Search Report dated Nov. 18, 2016 in corresponding European Patent Application No. 16 17 3821.

(Continued)

*Primary Examiner* — Patrick Cicchino
(74) *Attorney, Agent, or Firm* — Staas & Halsey LLP

(57) ABSTRACT

A paper feeding apparatus of an image forming apparatus is provided. The paper feeding apparatus includes a pickup unit configured to rotate about a first axis, a swing member configured to rotate about a second axis, and to move the pickup unit from a contact location to a separation location by pressing the pickup unit, an elastic member configured to provide an elastic force to the swing member, and a rotation limiter configured to limit a rotation angle at which the swing member rotates, wherein a momentum of the swing member is less than a momentum of the pickup unit, while the swing member presses the pickup unit and rotates.

20 Claims, 18 Drawing Sheets

(56) References Cited

U.S. PATENT DOCUMENTS

| | | | | |
|---|---|---|---|---|
| 7,597,313 | B2 * | 10/2009 | Dan | B41J 13/103 271/10.03 |
| 8,231,122 | B2 * | 7/2012 | Tu | B65H 3/0684 271/117 |
| 8,292,289 | B2 * | 10/2012 | Kotaka | B65H 3/0684 271/117 |
| 8,628,077 | B2 | 1/2014 | Morimoto et al. | |
| 8,708,330 | B2 * | 4/2014 | Hida | B65H 3/0684 271/117 |
| 8,807,556 | B2 * | 8/2014 | Sugiyama | B65H 3/0684 271/124 |
| 9,221,633 | B2 * | 12/2015 | Lee | B65H 3/0684 |
| 9,221,634 | B2 * | 12/2015 | Tanaka | B65H 3/0669 |
| 9,242,817 | B2 * | 1/2016 | Suganuma | B65H 5/36 |
| 2008/0018044 | A1 | 1/2008 | Kim | |
| 2010/0025927 | A1 | 2/2010 | Kotaka et al. | |
| 2013/0334762 | A1 * | 12/2013 | Matsuoka | B65H 5/06 271/4.01 |
| 2015/0084268 | A1 * | 3/2015 | Lee | B65H 3/0684 271/117 |
| 2015/0321862 | A1 * | 11/2015 | Song | B65H 3/0684 271/117 |
| 2015/0344245 | A1 * | 12/2015 | Matsuo | B65H 1/266 271/264 |
| 2016/0257508 | A1 * | 9/2016 | Nishiyama | B65H 3/0684 |

OTHER PUBLICATIONS

European Office Action dated Jul. 26, 2017 in corresponding European Patent Application No. 16 173 821.6.

* cited by examiner

PAPER FEEDING APPARATUS AND IMAGE FORMING APPARATUS ADOPTING THE SAME

CROSS-REFERENCE TO RELATED APPLICATION

This application claims the priority benefit of Korean Patent Application No. 10-2015-0100519, filed on Jul. 15, 2015, in the Korean Intellectual Property Office, the disclosure of which is incorporated herein in its entirety by reference.

BACKGROUND

1. Field

The present disclosure relates to paper feeding apparatuses and image forming apparatuses adopting the same.

2. Description of the Related Art

An image forming apparatus, particularly, an electrophotographic image forming apparatus prints an image on a recording medium by forming an electrostatic latent image on a surface of a visual receptor by emitting light, modulated in correspondence with image information, toward the visual receptor, developing the electrostatic latent image to form a visible toner image by supplying toner to the electrostatic latent image, and fixing the visible toner image on the recording medium by transferring the visible toner image to the recording medium.

The image forming apparatus includes a paper feeding apparatus for picking up sheets of recording media, which are loaded in a loading table, one by one and supplying the recording media sheets to a printing apparatus. The paper feeding apparatus includes a pickup unit for picking up a loaded recording medium. The pickup unit includes a pickup roller that rotates in contact with the recording medium, and transports the recording medium through the pickup roller.

After the pickup unit picks up the recording medium, the pickup unit may return the pickup roller to an original location that is separate from the recording medium, so as to smoothly transport the recording medium and prevent redundant transport of the recording medium.

As an example, an elastic member may be employed so as to return the pickup roller to the original location, and a location control member may be employed so as to stop the pickup unit at a predetermined location.

However, while the pickup roller is returned to the original location as described above, the pickup unit may collide with a location control member, and thus, noise may occur due to the collision.

SUMMARY

Provided are paper feeding apparatuses for reducing noise that may be caused by an impact by reducing the impact that occurs while a pickup unit returns to an original location, and image forming apparatuses including the paper feeding apparatuses.

Additional aspects will be set forth in part in the description which follows and, in part, will be apparent from the description, or may be learned by practice of the presented exemplary embodiments.

According to an aspect of an exemplary embodiment, a paper feeding apparatus of an image forming apparatus includes a pickup unit including a pickup roller, and at least a part of the pickup unit configured to rotate about a first axis and to move between a contact location at which the pickup roller contacts a recording medium and a separation location at which the pickup roller is separate from the recording medium, a swing member configured to rotate about a second axis, and move the pickup unit from the contact location to the separation location by pressing the pickup unit, an elastic member configured to provide an elastic force to the swing member, so that the swing member rotates about the second axis, and a rotation limiter configured to limit a rotation angle at which the swing member rotates, wherein a momentum of the swing member is less than a momentum of the pickup unit while the swing member presses the pickup unit and rotates.

A rotation radius within which the swing member rotates may be less than a rotation radius within which the pickup unit rotates.

A distance from the second axis of the swing member to a point at which the swing member contacts the rotation limiter may be shorter than a distance from the first axis of the pickup unit to a rotation axis of the pickup roller.

A mass of the swing member may be less than a mass of the pickup unit.

A contact rod may be arranged in one of the pickup unit and the swing member, and a guide hole configured to guide movement of the contact rod may be arranged in an other one of the pickup unit and the swing member.

The paper feeding apparatus may include a housing that has an inner space to accommodate the pickup unit, and includes an opening through which the pickup unit may pass and an upper cover configured to open or close the opening.

The swing member and the elastic member may be installed on the upper cover.

The rotation limiter may be arranged on the upper cover.

The housing may include a first joint and a second joint, the first joint and the second joint configured to support both ends of the pickup unit in a direction in which the first axis of the pickup unit extends, and at least one selected from the first joint and the second joint may be elastically deformed in the direction in which the first axis extends.

The housing may be mounted in a main frame of the image forming apparatus, and configured to have a fixed location that is fixed to the main frame of the image forming apparatus, and a variable location that may be moved with respect to the main frame of the image forming apparatus.

The housing may include a locking member configured to fix the housing to the main frame, so that the housing is located in the fixed location.

The housing may include a support member configured to support the housing so that a location of the housing may be moved with respect to the main frame if the locking member is unfixed from the main frame.

According to an aspect of another exemplary embodiment, the image forming apparatus may include the paper feeding apparatus.

BRIEF DESCRIPTION OF THE DRAWINGS

These and/or other aspects will become apparent and more readily appreciated from the following description of the exemplary embodiments, taken in conjunction with the accompanying drawings.

DETAILED DESCRIPTION

Figure 1:
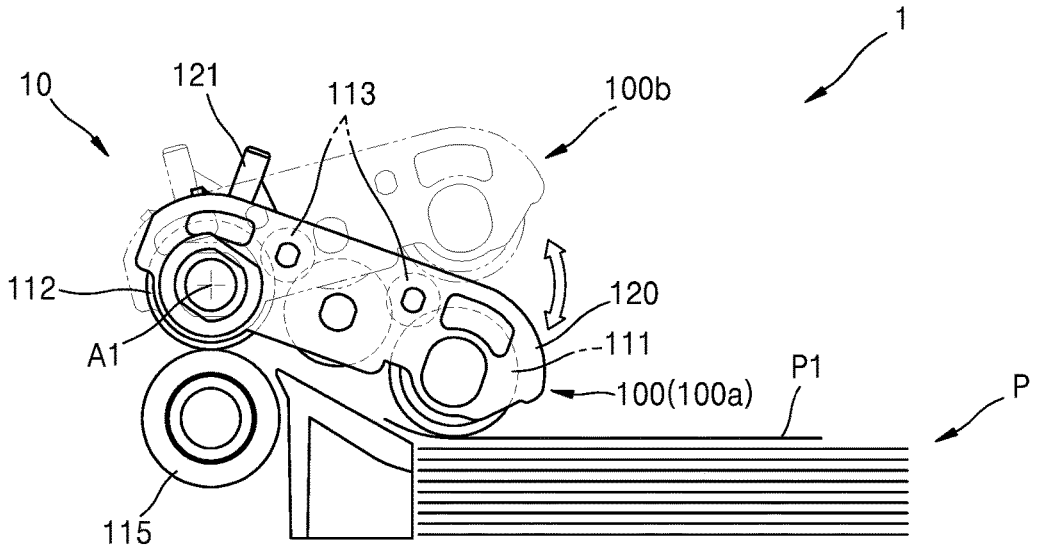
FIG. 1 illustrates a conceptual diagram of a paper feeding apparatus included in an image forming apparatus according to an embodiment.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects. As used herein, the term "and/or" includes any and all combinations of one or more of the associated listed items. Expressions such as "at least one of," when preceding a list of elements, modify the entire list of elements and do not modify the individual elements of the list.

Hereinafter, elements and effects of embodiments will be described in detail by explaining embodiments with reference to the attached drawings.

Terms used herein will be briefly described, and the embodiments will be described in detail below.

General and widely-used terms have been employed herein, in consideration of functions provided in the embodiments, and may vary according to an intention of one of ordinary skill in the art, a precedent, or emergence of new technologies. Additionally, in some cases, an applicant may arbitrarily select specific terms. Then, the applicant will provide the meaning of the terms in the description of the embodiments. Accordingly, It will be understood that the terms, used herein, should be interpreted as having a meaning that is consistent with their meaning in the context of the relevant art and will not be interpreted in an idealized or overly formal sense unless expressly so defined herein.

It will be further understood that the terms "comprises," "comprising," "includes," and/or "including," when used herein, specify the presence of components, but do not preclude the presence or addition of one or more other components, unless otherwise specified.

It will be understood that although the terms "first", "second", etc. may be used herein to describe various components, these components should not be limited by these terms. These components are only used to distinguish one component from another.

Embodiments will now be described more fully with reference to the accompanying drawings, in which the embodiments are shown. The embodiments may, however, be embodied in many different forms and should not be construed as being limited to the embodiments set forth herein. In the description of the embodiments, certain detailed explanations of the related art are omitted when it is deemed that they may unnecessarily obscure the essence of the embodiments. Like numbers refer to like elements throughout the description of the figures.

FIG. 1 illustrates a conceptual diagram of a paper feeding apparatus 10 included in an image forming apparatus 1 according to an embodiment.

Referring to FIG. 1, the image forming apparatus 1 includes at least one paper feeding apparatus 10.

A paper feeding apparatus 10 includes a pickup unit 100 that contacts a loaded recording medium P and transports the recording medium P in a transport direction.

The pickup unit 100 may include a pickup roller 111 that may contact the recording medium P, and a forward roller 112 for transporting the recording medium P, picked up by the pickup roller 111, in a transport direction. The pickup roller 111 and the forward roller 112 may engage with each other and rotate. For example, as shown in FIG. 1, the forward roller 112 and the pickup roller 111 may be connected to each other by using a gear 113. Alternately, the forward roller 112 and the pickup roller 111 may be connected to each other by using a belt (not shown). However, since the forward roller 112 is an optional element in the pickup unit 100, the forward roller 112 may not be included in the pickup unit 100, depending on necessity.

The pickup unit 100 may rotate about a first axis A1. As the pickup unit 100 rotates about the first axis A1, a location of the pickup roller 111 included in the pickup unit 100 may be moved. For example, the pickup unit 100 may move between a contact location 100*a* where the pickup roller 111 contacts a recording medium P and a separation location 100*b* to which the pickup roller 111 is separated from the recording medium P.

When the pickup unit 100 is located in the contact location 100*a*, as the pickup roller 111 and the forward roller 112 rotate, a recording medium P1 located uppermost from among loaded recording media P, is transported in a transport direction.

Figure 2:
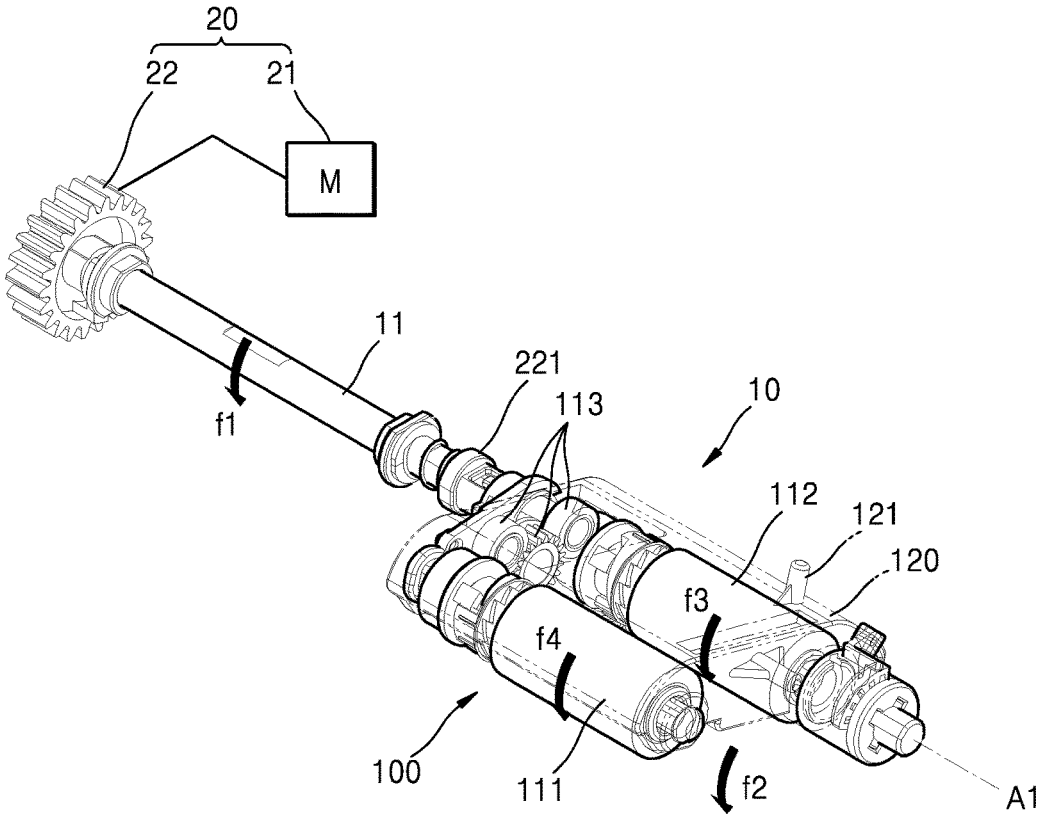
FIG. 2 illustrates a diagram for explaining an example of a structure of the image forming apparatus, in which a pickup unit moves to a contact location and a pickup roller and a forward roller rotate, according to an embodiment.

FIG. 2 illustrates a diagram for explaining an example of a structure of the image forming apparatus 1, in which the pickup unit 100 moves to the contact location 100*a* of FIG. 1 and the pickup roller 111 and the forward roller 112 rotate, according to an embodiment. Elements of the paper feeding apparatus 10 shown in FIG. 2, other than the pickup up unit 100 and a driving axis 11, are not described for convenience of description.

Referring to FIG. 2, the image forming apparatus 1 may include the driving unit 20 for providing a driving force to the paper feeding apparatus 10. The driving unit 20 may include a driving motor 21 and at least one driving gear 22.

The paper feeding apparatus includes the pickup unit 100 described above, and the driving axis 11 for delivering a driving force to the pickup unit 100.

An end of the driving axis 11 is connected to the driving unit 20, and the other end of the driving axis 11 is connected to the pickup unit 100. The driving force is delivered to the pickup unit 100 by the driving unit 20 via the driving axis 11.

For example, when the driving unit 20 rotates in a forward direction, the driving axis 11 connected to the driving unit 20 and the pickup unit 100 connected to the driving axis 11 rotate about a first axis A1 in a forward direction f1. Accordingly, the pickup unit 100 may move from the separation location 100*b* to the contact location 100*a*.

The forward roller 12 may rotate, and a rotation axis of the forward roller 112 may be coaxially connected to the first axis A1. When the pickup unit 100 rotates about the first axis A1 in a forward direction f2, the forward roller 112, coaxially connected to the pickup unit 100, also rotates about a rotation axis in a forward direction f3. Accordingly, the pickup roller 111 engaged with the forward roller 112 rotates about a rotation axis in a forward direction f4.

In other words, the pickup unit 100 rotates about the first axis A1 according to the driving force provided by the driving unit 20, and thus, the pickup unit 100 moves from the separation location 100*b* to the contact location 100*a* and the forward roller 112 and the pickup roller 111 included in the pickup unit 100 rotate. Accordingly, the recording medium P is transported in a transport direction.

However, according to the embodiment described above, the structure in which a driving force is delivered to the pickup unit 100 is only an example, and may be changed appropriately as needed. For example, although not shown in the drawing, a structure in which a driving force is delivered to the pickup unit 100 to rotate the pickup unit 100 and a structure in which a driving force is delivered to the pickup unit 100 to rotate the pickup roller 111 and the forward roller 112 may be separate from each other.

After the recording medium P is transported by the pickup unit 100, the providing of the driving force to the pickup unit 100 by the driving unit 20 may be stopped. Accordingly, the rotation of the driving axis 11 is stopped, and a force for moving the pickup unit 100 to the contact location 100*a* may be stopped or released.

When the providing of the driving force to the pickup unit 100 by the driving unit 20 is stopped, the pickup unit 100 may move from the contact location 100*a* to the separation location 100*b*.

Hereinafter, referring to FIGS. 3A through 5B, according to an embodiment, an example of a structure in which the pickup unit 100 included in the paper feeding apparatus 10 moves from the contact location 100*a* to the separation location 100*b* is described.

Figure 3A:
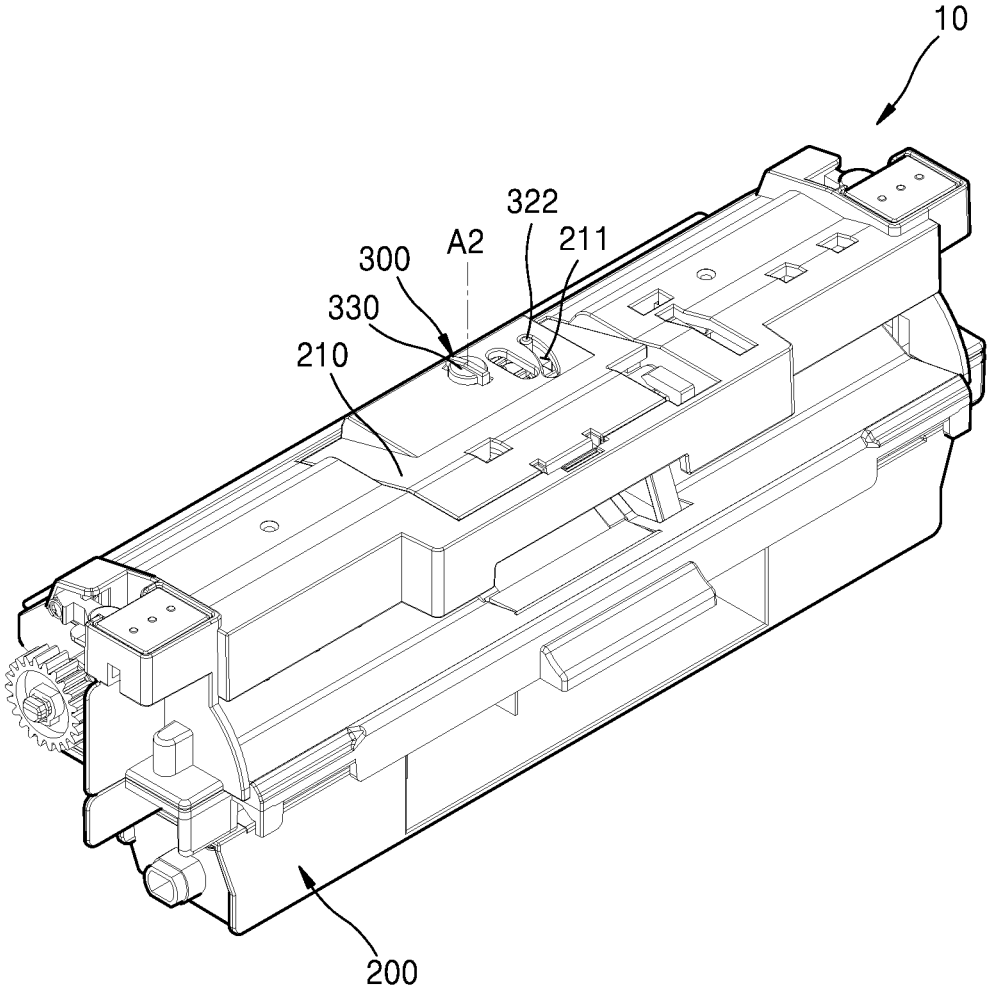
FIGS. 3A and 3B are perspective views of an example of the paper feeding apparatus according to an embodiment.
Figure 3B:
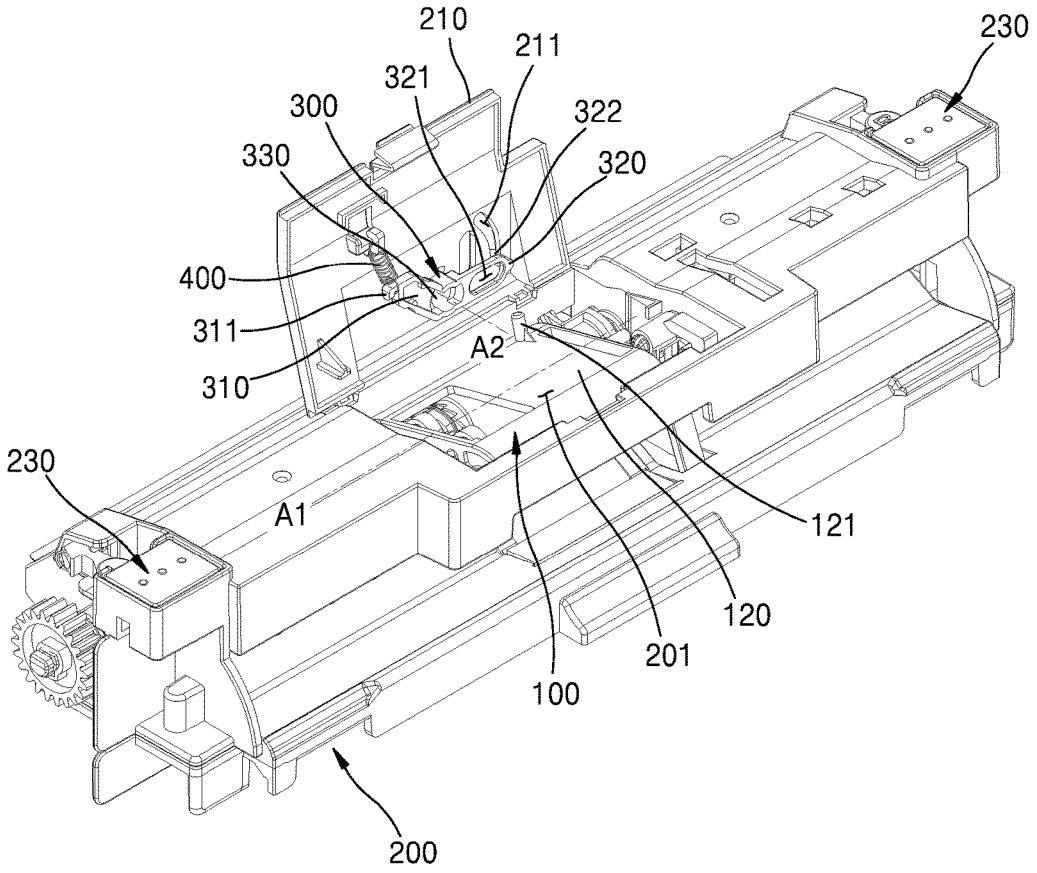
Figure 4A:
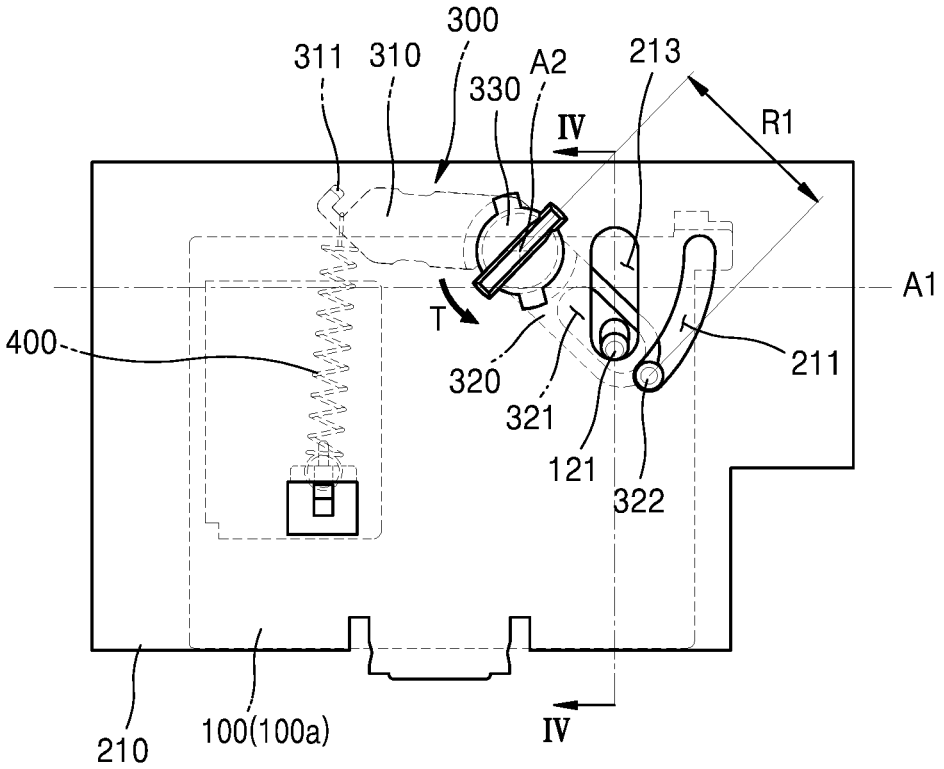
FIGS. 4A and 4B respectively illustrate a plan view and a cross-sectional view of the paper feeding apparatus shown in FIG. 3.
Figure 4B:
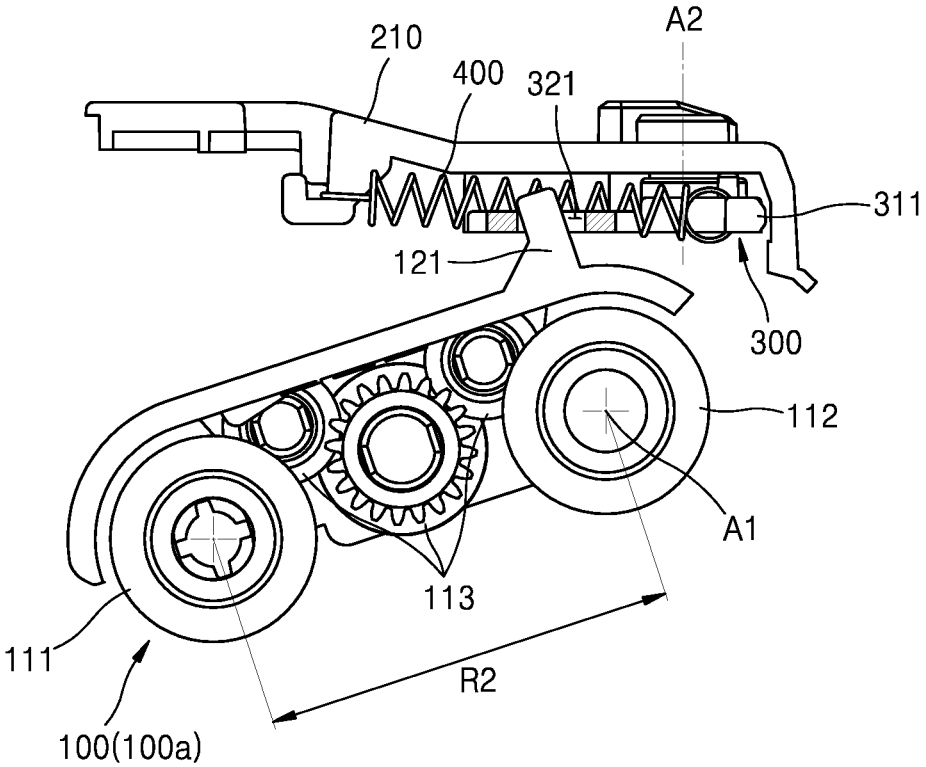
Figure 5A:
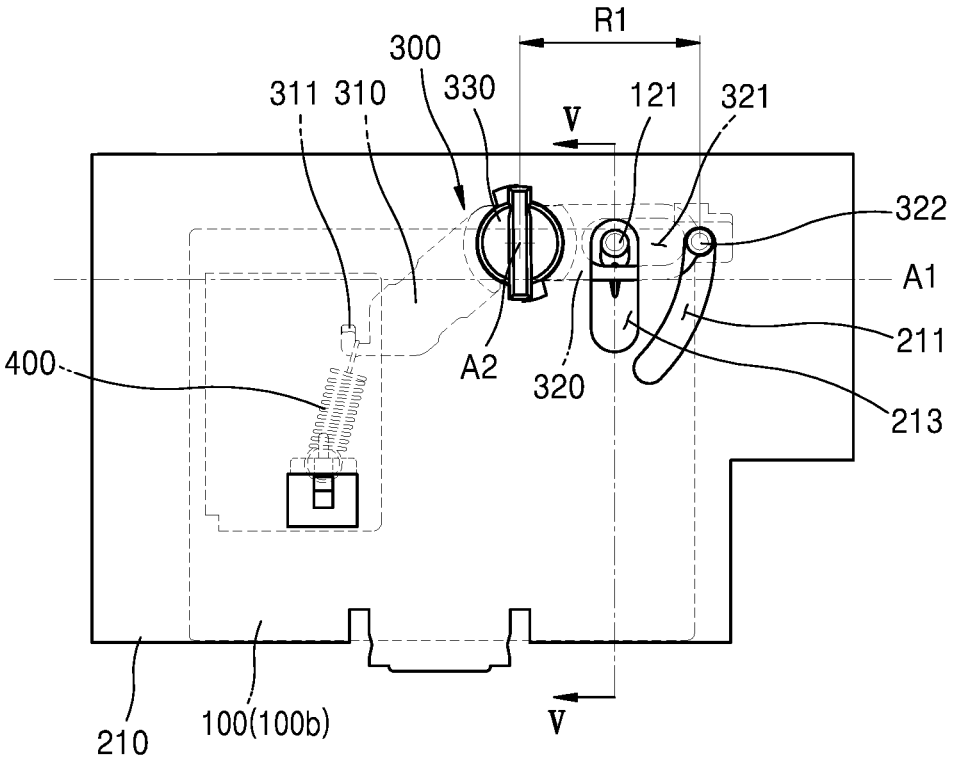
FIGS. 5A and 5B respectively illustrate a plan view and a cross-sectional view of the paper feeding apparatus having a swing member that is rotated about a second axis.
Figure 5B:
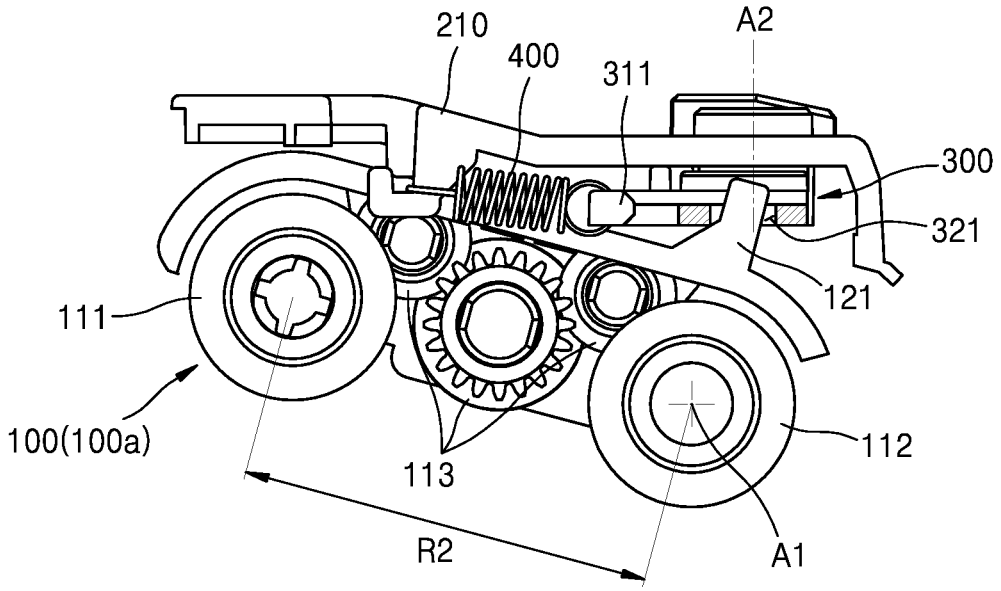

FIGS. 3A and 3B are perspective views of an example of the paper feeding apparatus 10 according to an embodiment. FIGS. 4A and 4B respectively illustrate a plan view and a cross-sectional view of the paper feeding apparatus 10 shown in FIG. 3A. FIGS. 5A and 5B respectively illustrate a plan view and a cross-sectional view of the paper feeding apparatus 10 having a swing member 300 that is rotated about a second axis A2.

Referring to FIGS. 3A, 3B, 4A, and 4B, the paper feeding apparatus 10 includes a housing 200 having an inner space that may accommodate the pickup unit 100. The housing 200 may include an opening 201 through which the pickup unit 100 may pass, and an upper cover 210 that may open or close the opening 201.

The pickup unit 100 includes the pickup roller 111 and the forward roller 112 which are described above, a gear, and a case 120 accommodating the same. The pickup unit 100 may be supported by the housing 200 so that the pickup unit 100 may rotate about the first axis A1.

The swing member 300 may rotate about the second axis A2. For example, the swing member 200 includes a second shaft 330 that rotates about the second axis A2, a first connection area 310 extending from the second shaft 330, and a second connection area 320 extending from the second shaft 330. A direction in which the first connection area 310 extends may be different from a direction in which the second connection area 320 extends.

The first connection area 310 may be connected to an elastic member 400. For example, a hook 311 supporting an end of the elastic member 400 may be formed on the first connection area 310.

The second connection area 320 may be connected to the case 120 of the pickup unit 100. For example, a guide hole 321 is formed in the second connection area 320, and a contact rod 121 that may be inserted into the guide hole 321 may be formed on the case 120. A size of the guide hole 321 may be greater than a size of the connection rod 121. For example, a width of the guide hole 321 in a direction perpendicular to a direction in which the second connection 320 extends may be greater than a diameter of the contact rod 121.

According to an embodiment, an example in which the guide hole 321 is formed on the swing member 300 and the contact rod 121 is formed on the pickup unit 100 is described. However, locations where the guide hole 321 and the contact rod 121 are formed are not limited thereto, and may vary as needed. For example, the contact road 121 may be formed in the second connection area 320, and the guide hole 321 may be formed on the case 120.

Hereinafter, operation of the pick up 100 having the above-described structure is described.

Referring to FIGS. 4A and 4B, when the pickup unit 100 is in the contact location 100*a*, the contact road 121 included in the pickup unit 100 is inserted into the guide hole 321 on the swing member 300. Since the elastic member 400 connected to the swing member 300 is sufficiently expanded, a torque T for rotating the swing member 300 about the second axis A2 in a counterclockwise direction is exerted on the swing member 300. However, while a driving force is being provided to the pickup unit 100 by the driving unit 20, since a force for maintaining the pickup unit 100 in the contact location 100*a* is greater than the torque T, the pickup unit 100 is located in the contact location 100*a*.

In such a state that the pickup unit 100 is located in the contact location 100*a* and the contact road 121 is inserted into the guide hole 321, the providing of the driving force by the driving unit 20 may be stopped, and a force for maintaining the pickup unit 100 in the contact location 100*a* may be released. Accordingly, a force of limiting rotation of the swing member 300 is released. Thus, the swing member 300 is rotated about the second axis A2 in a counterclockwise direction by the elastic member 400.

Referring to FIGS. 5A and 5B, while the swing member 300 is rotating in a counterclockwise direction, the guide hole 321 on the swing member 300 contacts and presses the contact rod 121 in the pickup unit 100. The contact rod 121 moves by the pressing by the guide hole 321, and the case 120 of the pickup unit 100 on which the contact rod 121 is formed rotates about the first axis A1. The movement of the contact rod 121 may be checked from outside through a long hole 213 formed on the upper cover 210. The long hole 213 may also guide movement of the contact rod 121.

The rotation limiter 121 may limit an angle at which the swing member 300 rotates. The rotation limiter 211 may limit rotation of the swing member 300 at a certain angle or greater. The rotation of the swing member 300 may be stopped by the rotation limiter 211, and a location where the swing member 300 rotates may be controlled. As the location where the swing member 300 rotates is controlled, a location where the pickup unit 100 rotates may be indirectly controlled. Accordingly, the pickup unit 100 may be moved from the contact location 100*a* to the separation location 100*b*.

The rotation limiter 211 may be located within a radius of the swing member 300. When a protrusion 322 formed on the swing member 300 rotates about the second axis A2, the rotation limiter 211 may be arranged in a location where the rotation limiter 211 interferes with movement of the protrusion 322. For example, a groove in a form of an arc may be formed on the upper cover 210, and the rotation limiter 211 may be an inner surface of the groove that limits movement of the protrusion 322. However, a form and arrangement of the rotation limiter 211 are not limited thereto, and may be variously modified so that an angle at which the swing member 300 rotates is limited.

As described above, according to an embodiment, the paper feeding apparatus 10 has a structure in which an elastic force of the elastic member 400 is delivered to the pickup unit 100 by the swing member 300, and rotation of the swing member 300 is limited by the rotation limiter 211. An impact that may occur while the pickup unit in the paper feeding apparatus 10 moves from the contact location 100*a* to the separation location 100*b* may be easily adjusted by using such a structure.

An impact may be determined by changes in mass and speed. However, there is a limit in reducing a size and mass of the pickup unit 100 by using the pickup unit 100 due to a function and a structure of the pickup unit 100 for picking up and transporting the recording medium P. Accordingly, there is a limit to reducing the impact by decreasing changes in mass and speed of the pickup unit 100.

Since the swing member 300 delivers an elastic force provided by the elastic member 400 to the pickup unit 100, it may be easy to reduce a size and mass of the swing member 300 compared to those of the pickup unit 100. Accordingly, an impact, which may occur while the pickup unit 100 in the paper feeding apparatus 10 moves from the contact location 100*a* to the separation location 100*b*, may be easily reduced.

An impact may be an amount of a change in momentum. Accordingly, an impact that may occur in the paper feeding apparatus 10 may be reduced by designing momentum of the swing member 300 to be less than that of the pickup unit 100.

For example, a rotation radius R1 within which the swing member 300 rotates may be less than a rotation radius R2 within which the pickup unit 100 rotates. A definition of the rotation radii R1 and R2 may vary. For example, the rotation radius R1 within which the swing member 300 rotates may be a distance from the second axis A2 to the protrusion 322 that is a point where the swing member 300 contacts the rotation limiter 211. The rotation radius R2 within which the pickup unit 100 rotates may be a distance from the first axis A1 to a rotation axis of the pickup roller 111.

If the rotation radius R1 within which the swing member 300 rotates is determined as being less than the rotation radius R2 within which the pickup unit 100 rotates, when the swing member 300 and the pickup unit 100 respectively rotate, a speed at which the swing member 300 rotates may be less than a speed at which the pickup unit 100 rotates.

A structure of the swing member 300 may be simpler than that of the pickup unit 100 that includes the pickup roller 111 or the like. Mass of the swing member 300 may be less than mass of the pickup unit 100.

As described above, an impact that may occur when the pickup unit 100 included in the paper feeding apparatus 10 returns from the contact location 100*a* to the separation location 100*b* may be reduced by determining a speed at which the swing member 300 rotates as being less than a speed at which the pickup unit 100 rotates, and determining mass of the swing member 300 as being less than mass of the pickup unit 100. Accordingly, noise that may occur in the paper feeding apparatus 10 may be reduced.

Figure 6A:
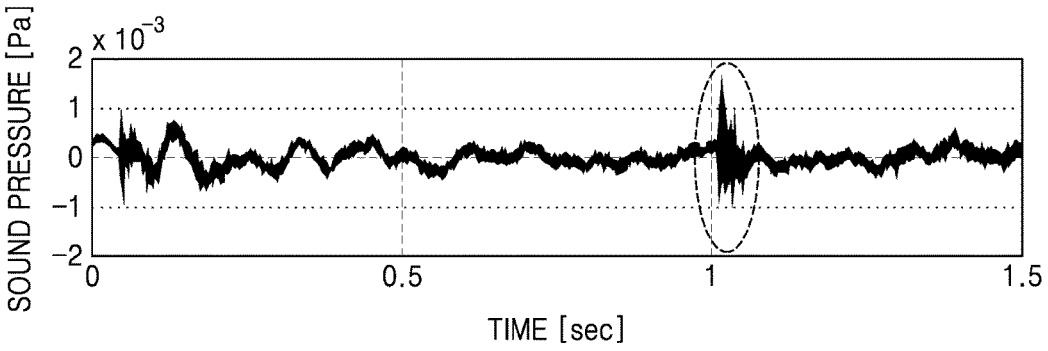
FIG. 6A is a graph showing a magnitude of noise generated in a paper feeding apparatus according to a comparative example.
Figure 6B:
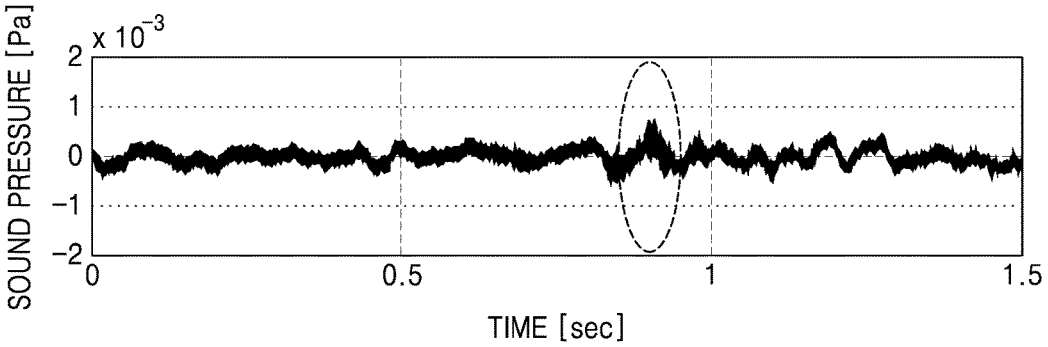
FIG. 6B illustrates a graph showing a magnitude of noise generated in the paper feeding apparatus according to an embodiment.

FIG. 6A is a graph showing a magnitude of noise generated in the paper feeding apparatus 10 according to a comparative example, and FIG. 6B illustrates a graph showing a magnitude of noise generated in the paper feeding apparatus 10 according to an embodiment.

In the paper feeding apparatus 10 described with reference to FIG. 6A, a structure in which the elastic member 400 is directly connected to the pickup unit 100 instead of using the swing member 300, and a rotation limiter collides with the pickup unit 100, and thus, stops rotation of the pickup unit 100 is employed. In the paper feeding apparatus 10 described with reference to FIG. 6B, as shown in FIG. 3A, the swing member 300 is arranged between the elastic member 400 and the pickup unit 100, and the swing member 300 collides with the rotation limiter 211, and thus, stops rotation of the swing member 300 and rotation of the pickup unit 100. In FIGS. 6A and 6B, the pickup units 100 having a same mass and a same rotation radius are employed, and a mass of the swing member 300 and a rotation radius R1 at which the swing member 300 rotates are less than the mass of each pickup unit 100 and a rotation radius R2 at which each pickup unit 100 rotates.

Referring to FIG. 6A, in the comparative example, it may be understood that noise of about $1.5\times10^{-3}$ Pa has occurred at about 1 second. Referring to FIG. 6B, according to an embodiment, it may be understood that noise of about $0.7\times10^{-3}$ Pa has occurred once, and noise of about $1\times10^{-3}$ Pa or greater has not occurred in the paper feeding apparatus 10.

Accordingly, it may be understood that a structure, in which the swing member 300 is arranged between the pickup unit 100 and an elastic member and rotation of the swing member 300 is limited, is employed so as to return the pickup unit 100 from the contact location 100*a* to the separation location 100*b*, and thus, noise that may occur in the paper feeding apparatus 10 may be reduced to about half of the noise.

Referring to FIGS. 3A through 4B, the swing member 300 and the elastic member 400 may be arranged on the upper cover 210 of the housing 200.

The swing member 300 may be installed on the upper cover 210 so that the swing member 300 may rotate. For example, the second shaft 330 of the swing member 300 may be assembled on the upper cover 210 so that the second shaft 330 may rotate. The swing member 300 and the pickup unit 100 are connected to each other by inserting the contact rod 121 into the guide hole 321.

The elastic member 400 may not be directly connected to the pickup unit 100, but connected to the swing member 300. For example, an end of the elastic member 400 may be connected to the upper cover 210, and the other end of the elastic member 400 may be connected to a hook 311 of the first connection area 310 of the swing member 300.

As described above, the pickup unit 100 is connected to the swing member 300 by inserting the contact rod 121 into the guide hole 321 of the swing member 300, but not connected to other areas of the swing member 300 and an elastic member. Accordingly, a user may separate the swing member 300 from the pickup unit 100, just by opening the upper cover 210.

Figure 7:
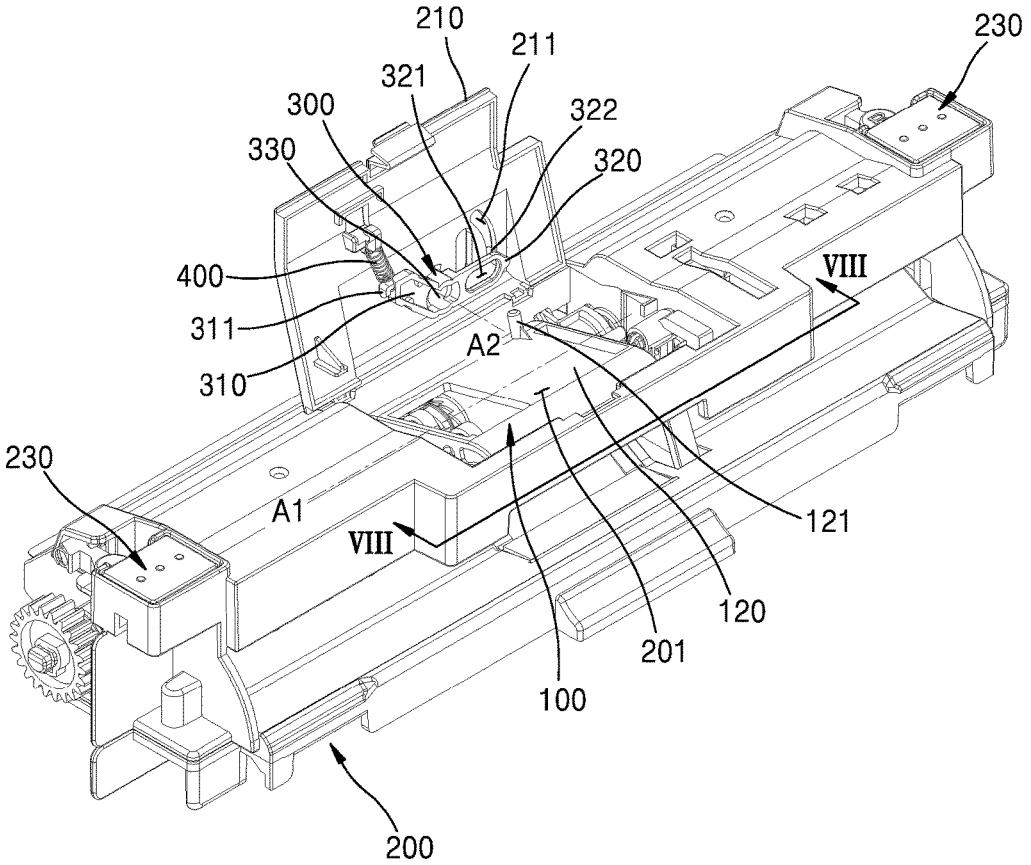
FIG. 7 is a perspective view of the paper feeding apparatus for explaining a process of separating the pickup unit from the paper feeding apparatus, according to an embodiment.
Figure 8A:
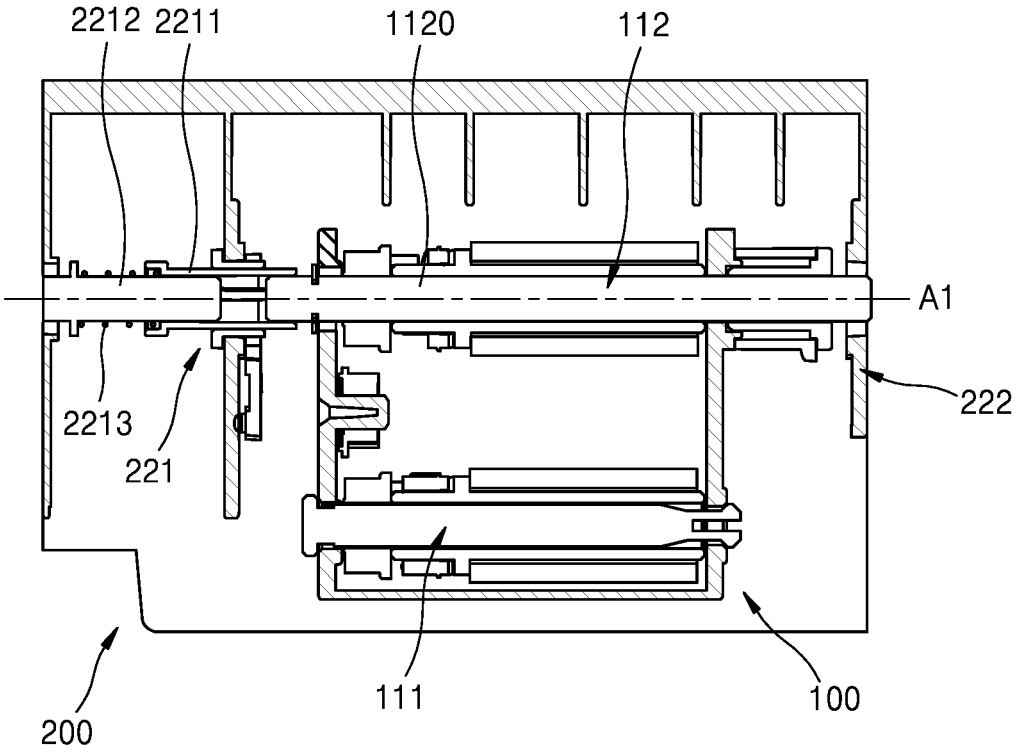
FIG. 8A is a cross-sectional view of the feeding apparatus taken along a line VIII-VIII shown in FIG. 7.
Figure 8B:
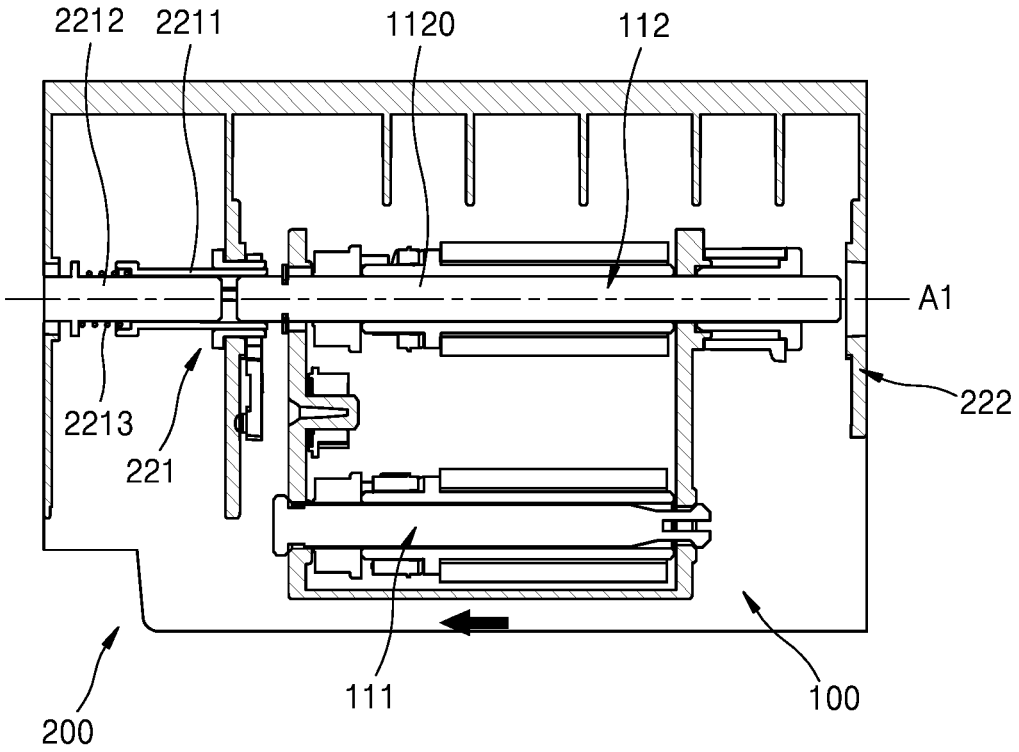
FIG. 8B is a cross-sectional view of the paper feeding apparatus shown in FIG. 8A, after the pickup unit is moved in a direction parallel with a first axis.

FIG. 7 is a perspective view of the paper feeding apparatus 10 for explaining a process of separating the pickup unit 100 from the paper feeding apparatus 10, according to an embodiment. FIG. 8A is a cross-sectional view of the paper feeding apparatus 10 taken along a line VIII-VIII shown in FIG. 7, and FIG. 8B is a cross-sectional view of the paper feeding apparatus 10 shown in FIG. 8A, after the pickup unit 100 is moved in a direction parallel with a first axis A1. A process of separating the pickup unit 100 from the housing 200 is described with reference to FIGS. 7, 8A, and 8B.

Referring to FIGS. 7 and 8A, the pickup unit 100 is supported by the housing 200 so that the pickup unit 100 may rotate. The housing 200 includes a first joint 221 and a second joint 222 which supports the pickup unit 100 so that the pickup unit 100 may rotate.

At least one of the first and second joints 221 and 222 may be elastically deformed in a direction in which the first axis A1 extends. For example, the first joint 221 may be elastically deformed in a direction in which the first axis A1 extends. The first joint 221 may include a supporter 2211 supporting an end of a rotation shaft 1120 of the forward roller 112, a connection shaft 2212 inserted into the supporter 2211, and an elastic member 2213 pressing the supporter 2211. The first joint 221 may be connected to the driving axis 11 shown in FIG. 2.

Referring to FIGS. 7 and 8B, a user may expose the pickup unit 100, installed inside the housing 200, to outside by opening the upper cover 210. Then, a force may be applied to the pickup unit 100 in a direction from among directions in which the first axis A1 extends, for example, in a left direction. Accordingly, the first joint 221 supporting an end of the pickup unit 100 is elastically deformed in the left direction, and the pickup unit 100 moves in the left direction. As the pickup unit 100 moves in the left direction, the other end of the pickup unit 100 is separated from the second joint 222. Accordingly, the user may separate the pickup unit 100 from the housing 200. Thus, the use may separate the pickup unit 100 from the housing 200 without having to perform a complex separation process.

Figure 9A:
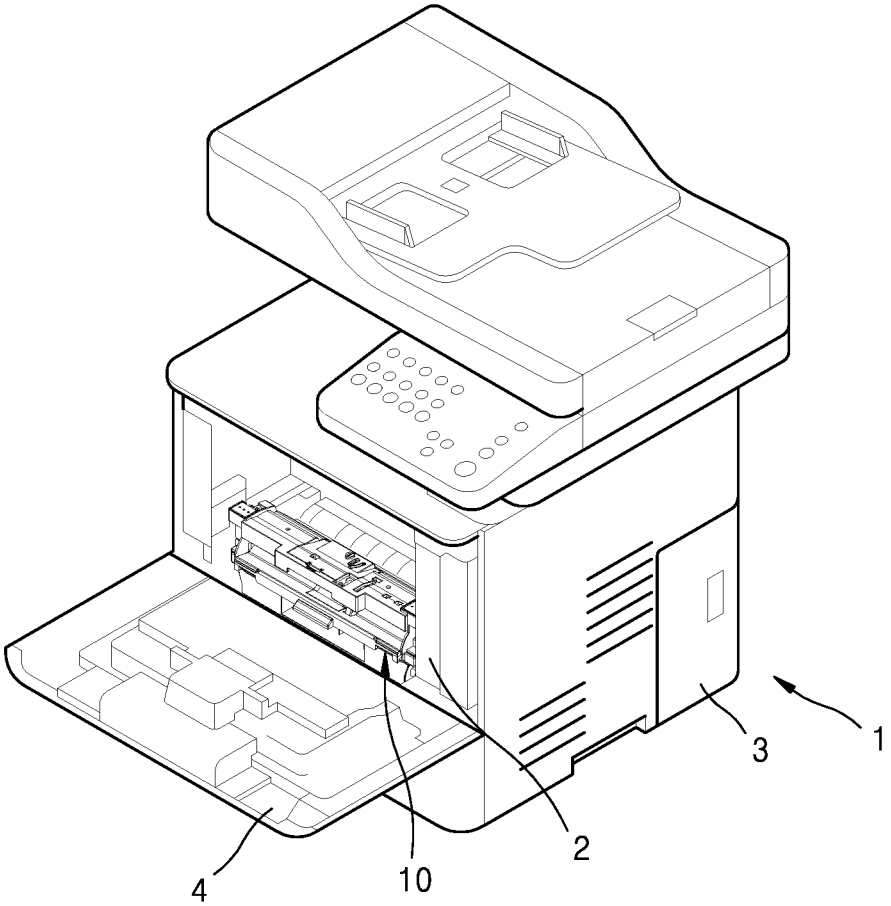
FIG. 9A illustrates a diagram showing a state when the paper feeding apparatus is mounted in and fixed to a main frame of the image forming apparatus.
Figure 9B:
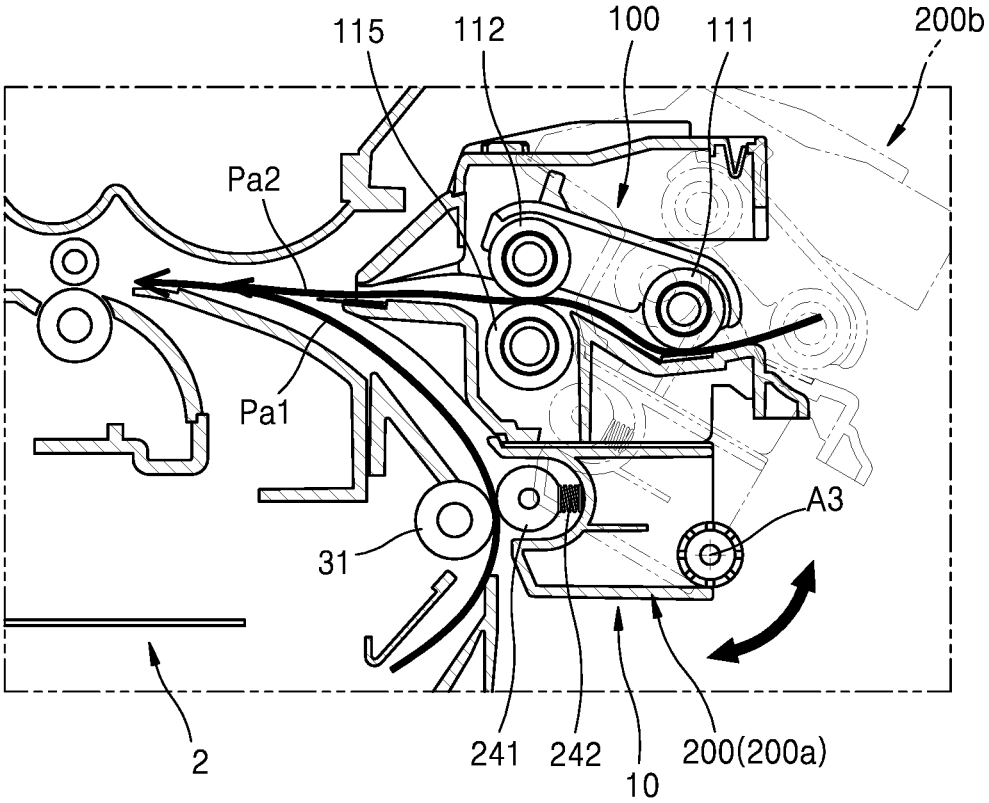
FIG. 9B illustrates an example of a cross-sectional view of part of an area of the image forming apparatus which is shown in FIG. 9A and includes the paper feeding apparatus.
Figure 10:
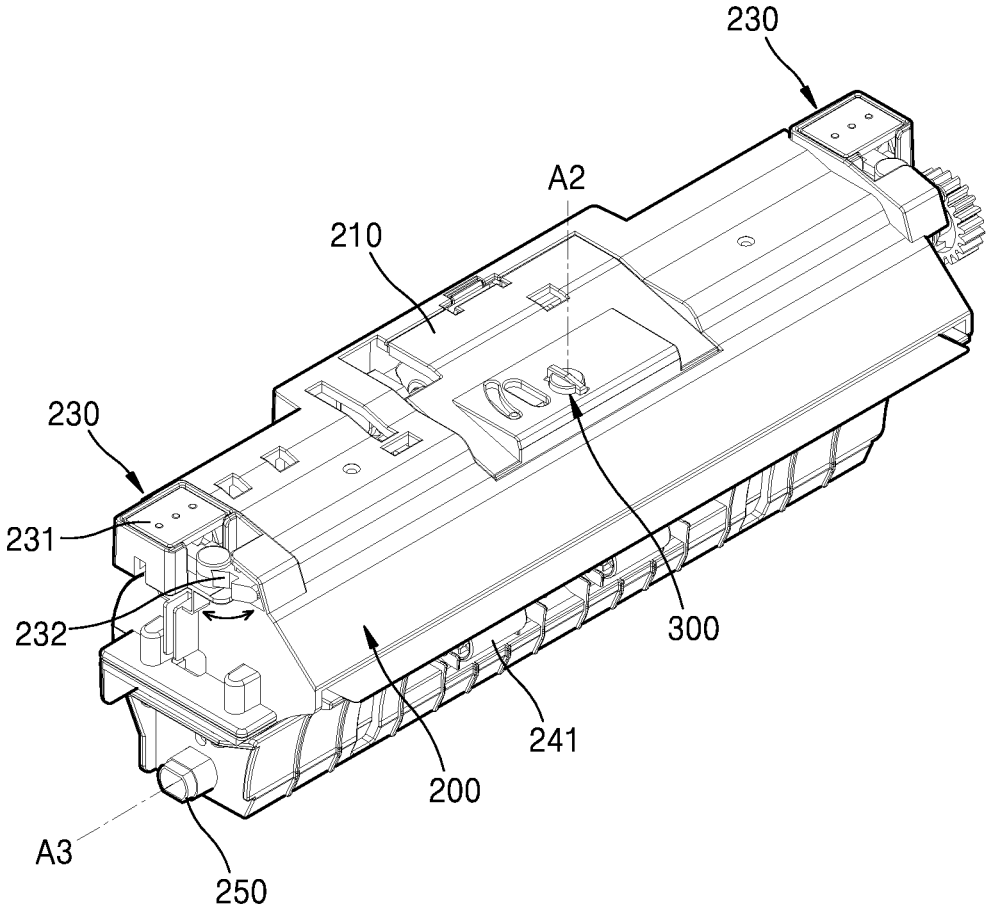
FIG. 10 is a perspective view of the paper feeding apparatus according to an embodiment.
Figure 11A:
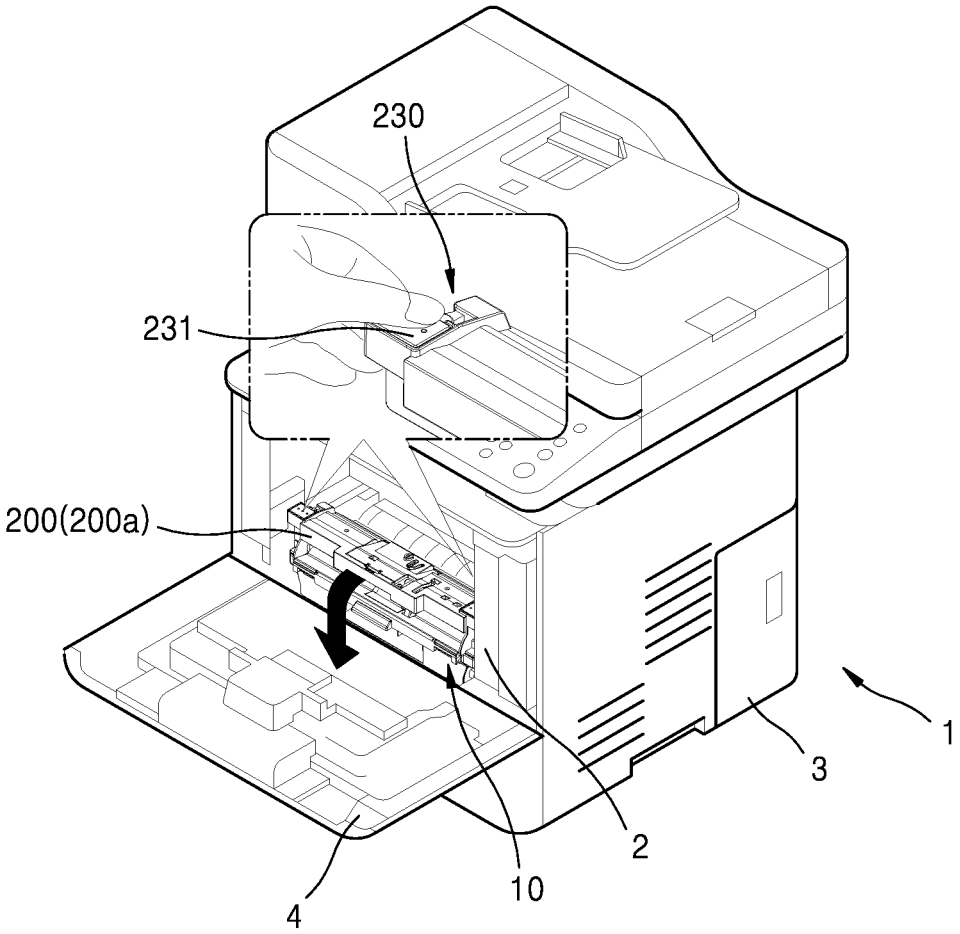
FIGS. 11A and 11B illustrate diagrams for explaining a process of resolving a jam in the image forming apparatus, according to an embodiment.
Figure 11B:
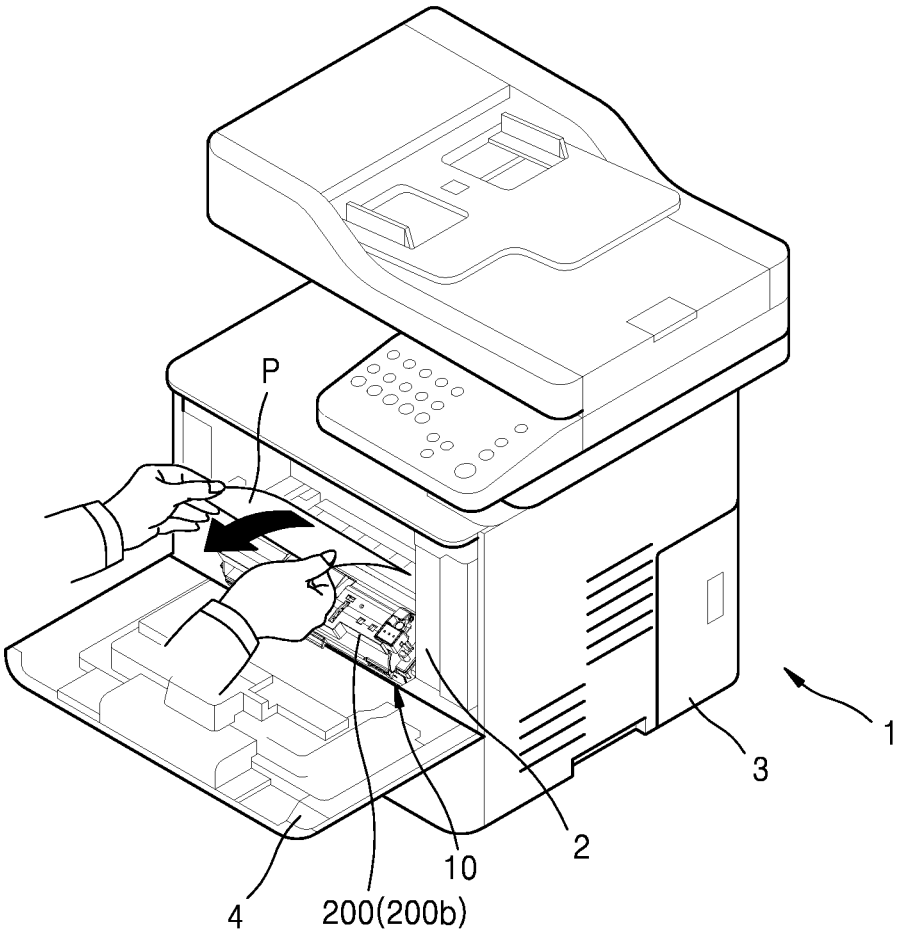

FIG. 9A illustrates a diagram showing a state when the paper feeding apparatus mounted in and fixed to a main frame 2 of the image forming apparatus 1, and FIG. 9B is a cross-sectional view of part of an area of the image forming apparatus 1 which is shown in FIG. 9A and includes the paper feeding apparatus 10. FIG. 10 is a perspective view of the paper feeding apparatus 10 according to an embodiment. FIGS. 11A and 11B illustrate diagrams for explaining a process of resolving a jam in the image forming apparatus 1, according to an embodiment.

Referring to FIGS. 9A and 9B, the image forming apparatus 1 may have a plurality of paper feeding paths. For example, the image forming apparatus 1 may have a first paper feeding path Pa1, via which a recording medium P loaded in a tray 3 included in the image forming apparatus 1 is supplied, and a second paper feeding path Pa2 supplied by the paper feeding apparatus 10 described above.

A feed roller 31 and a pressing roller 241 pressing the feed roller 31 may be arranged in the first paper path Pa1. The forward roller 112, the pickup roller 111, and a retard roller 115 included in the paper feeding apparatus 10 may be arranged in the second paper feeding path Pa2.

Referring to FIGS. 9A, 9B, and 10, the feed roller 31 may be arranged in the main frame 2 of the image forming apparatus 1, and the pressing roller 241 may be arranged in the paper feeding apparatus 10. The pressing roller 241 may press the feed roller 31 by using an elastic member 242. The pressing roller 241 and the elastic member 242 included in the paper feeding apparatus 10 may be referred to as a pressing structure, and the pressing structure may be variously modified so that the pressing structure has a structure pressing the feed roller 31.

When the housing 200 of the paper feeding apparatus 10 is installed in the main frame 2 of the image forming apparatus 1, the housing 200 may include a fixed location 200*a* that is fixed to the main frame 2 of the image forming apparatus 1, and a variable location 200*b* that move with respect to the main frame 2 of the image forming apparatus 1. According to an embodiment, movement of a location includes movement of a location of part of an area of the housing 200, and may include rotation as well as linear movement of the housing 200.

If the housing 200 of the paper feeding apparatus 10 is located in the fixed location 200*a*, the pressing roller 241 arranged in the paper feeding apparatus 10 presses the feed roller 31 arranged in the main frame 2. If the housing 200 of the paper feeding apparatus 10 is located in the variable location 200*b*, the pressing roller 241 arranged in the paper feeding apparatus 10 does not press the feed roller 31 arranged in the main frame 2.

For example, referring to FIG. 10, the housing 200 of the paper feeding apparatus 10 may include a locking member that fixes a location of the housing 200 to the main frame 2. The locking member 230 may be fixed to or unfixed from the main frame by controlling a button 231. For example, a hook member 232 included in the locking member 230 may rotate according to whether the button 231 is pressed. Accordingly, the hook member 232 may be fixed to or unfixed from the main frame 2. However, a structure of the locking member 230 is not limited thereto, and may be variously modified.

Additionally, the housing 200 of the paper feeding apparatus 10 may include a support member that supports the housing 200 so that the housing 200 may move with respect to the main frame 2 if the housing 200 is unfixed from the main frame 2 by using the locking member 230.

As an example, the support member may be a third shaft 250 that supports the housing 200 of the paper feeding apparatus 10 so that the housing 200 may rotate about a third axis A3 with respect to the main frame 2. The third shaft 250 may be arranged at both ends of the housing 200 of the paper feeding apparatus 10. A direction in which the third axis A3 extends may be parallel with a direction in which the first axis A1 of the pickup unit 100 extends.

If the housing 200 of the paper feeding apparatus 10 is located in the fixed location 200*a*, the third shaft 250 of the housing 200 is supported by the main frame 2, and the locking member 230 of the housing 200 is fixed to the main frame 2. According to an embodiment, the feed roller 31 is pressed by the pressing roller 241.

If a jam occurs such that the recording medium P is jammed in the image forming apparatus 1, a user may open a door 4 as shown in FIG. 11A, and then, release locking of the paper feeding apparatus 10 by pressing the button 231 on the locking member 230 of the paper feeding apparatus 10. The paper feeding apparatus 10 may be rotated about a third axis A3 with respect to the main frame 2. Accordingly, pressing between the feed roller 31 and the pressing roller 241 is released. Thus, if the housing 200 is located in the variable location 200*b*, the user may easily remove the recording medium P jammed in the image forming apparatus 1, as shown in FIG. 11B.

Figure 12:
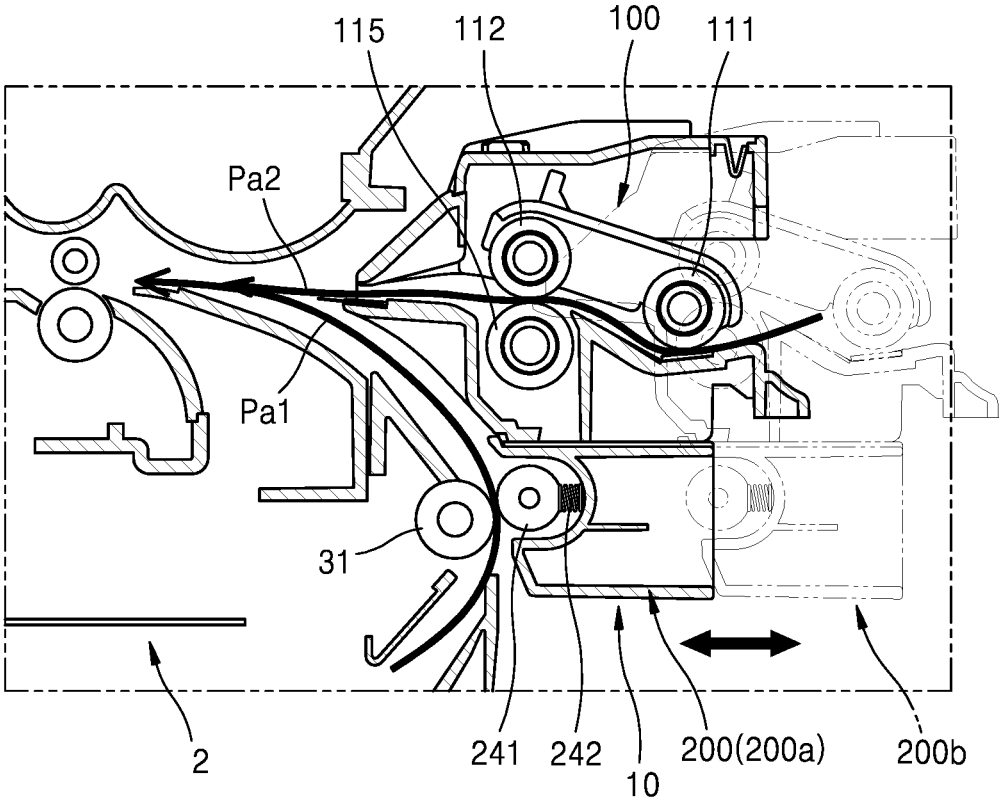
FIG. 12 illustrates another example of a cross-sectional view of part of an area of the image forming apparatus which is shown in FIG. 9A and includes the paper feeding apparatus.

According to the embodiment described above, a structure in which the paper feeding apparatus 10 rotates about the third axis A3 is described as an example in which the paper feeding apparatus 10 may move when the paper feeding apparatus 10 is located in the variable location 200*b*. However, a structure in which the paper feeding apparatus 10 may move when the paper feeding apparatus 10 is located in a variable location is not limited thereto, and may be variously modified. For example, the paper feeding apparatus 10 may include a sliding member that may slide with respect to the main frame 2. Accordingly, if locking of the paper feeding apparatus 10 by using the locking member 230 is released, the paper feeding apparatus 10 may slide, and thus, move as shown in FIG. 12.

According to one or more embodiments, a paper feeding apparatus and an image forming apparatus including the same may reduce an impact that may occur when a pickup unit moves from a contact location to a separation location, by delivering an elastic force of an elastic member by using a swing member and limiting rotation of the swing member by using a rotation limiter.

According to one or more embodiments, the paper feeding apparatus included in the image forming apparatus has been mainly described. However, the image forming apparatus may also include other elements for forming an image. Although not shown in the drawings, the image forming apparatus may include a developing unit, an exposure unit, a fixing unit, a discharge unit, or the like, in addition to the paper feeding apparatus.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. A paper feeding apparatus of an image forming apparatus, the paper feeding apparatus comprising:

a pickup unit comprising a pickup roller, and at least a part of the pickup unit to rotate about a first axis and to move between a contact location at which the pickup roller contacts a recording medium and a separation location at which the pickup roller is separate from the recording medium;

a swing member, located above a top of the pickup unit, to rotate about a second axis, perpendicular to the first axis, to move the pickup unit from the contact location to the separation location by pressing the pickup unit, and to maintain contact with the pickup unit when the pickup unit moves from the separation location to the contact location;

an elastic member to provide an elastic force to the swing member so that the swing member rotates about the second axis; and a rotation limiter to limit a rotation angle at which the swing member rotates, wherein a momentum of the swing member is less than a momentum of the pickup unit while the swing member presses the pickup unit and rotates.

2. The paper feeding apparatus of claim 1, wherein a rotation radius within which the swing member rotates is less than a rotation radius within which the pickup unit rotates.

3. The paper feeding apparatus of claim 1, wherein a distance from the second axis of the swing member to a point at which the swing member contacts the rotation limiter is shorter than a distance from the first axis of the pickup unit to a rotation axis of the pickup roller.

4. The paper feeding apparatus of claim 1, wherein a mass of the swing member is less than a mass of the pickup unit.

5. The paper feeding apparatus of claim 1, wherein a contact rod is arranged in one of the pickup unit and the swing member, and a guide hole to guide movement of the contact rod is arranged in an other one of the pickup unit and the swing member.

6. The paper feeding apparatus of claim 1, further comprising a housing that has an inner space to accommodate the pickup unit, and comprises an opening through which the pickup unit may pass and an upper cover to open or to close the opening.

7. The paper feeding apparatus of claim 6, wherein the swing member and the elastic member are installed on the upper cover.

8. The paper feeding apparatus of claim 6, wherein the rotation limiter is arranged on the upper cover.

9. A paper feeding apparatus of an image forming apparatus, the paper feeding apparatus comprising:

a pickup unit comprising a pickup roller, and at least a part of the pickup unit to rotate about a first axis and to move between a contact location at which the pickup roller contacts a recording medium and a separation location at which the pickup roller is separate from the recording medium;

a swing member to rotate about a second axis, and to move the pickup unit from the contact location to the separation location by pressing the pickup unit;

an elastic member to provide an elastic force to the swing member so that the swing member rotates about the second axis;

a rotation limiter to limit a rotation angle at which the swing member rotates; and a housing that has an inner space to accommodate the pickup unit, and comprises an opening through which the pickup unit may pass and an upper cover to open or to close the opening, wherein a momentum of the swing member is less than a momentum of the pickup unit while the swing member presses the pickup unit and rotates, wherein the housing comprises a first joint and a second joint, the first joint and the second joint to support both ends of the pickup unit in a direction in which the first axis of the pickup unit extends, and at least one selected from the first joint and the second joint is elastically deformed in the direction in which the first axis extends.

10. The paper feeding apparatus of claim 6, wherein the housing is mounted in a main frame of the image forming apparatus to be movable with respect to the main frame of the image forming apparatus.

11. The paper feeding apparatus of claim 10, wherein the housing comprises a locking member to fix the housing to the main frame, so that a location of the housing is fixed.

12. The paper feeding apparatus of claim 11, wherein the housing comprises a support member to support the housing so that a location of the housing may be moved with respect to the main frame if the locking member is unfixed from the main frame.

13. An image forming apparatus, comprising:

a paper feeding apparatus including:

a pickup unit including a pickup roller, and at least part of the pickup unit to rotate about a first axis and to move between a contact location at which the pickup roller contacts a recording medium and a separation location at which the pickup roller is separate from the recording medium, a swing member, located above a top of the pickup unit, to rotate about a second axis, perpendicular to the first axis, to move the pickup unit from the contact location to the separation location by pressing the pickup unit, and to maintain contact with the pickup unit when the pickup unit moves from the separation location to the contact location an elastic member to provide an elastic force to the swing member, so that the swing member rotates about the second axis, and a rotation limiter to limit a rotation angle at which the swing member rotates, wherein a momentum of the swing member is less than a momentum of the pickup unit while the swing member presses the pickup unit and rotates.

14. The image forming apparatus of claim 13, wherein a rotation radius within which the swing member rotates is less than a rotation radius within which the pickup unit rotates.

15. The image forming apparatus of claim 13, wherein a distance from the second axis of the swing member to a point at which the swing member contacts the rotation limiter is shorter than a distance from the first axis of the pickup unit to a rotation axis of the pickup roller, and a mass of the swing member is less than a mass of the pickup unit.

16. The image forming apparatus of claim 13, wherein a contact rod is arranged in one of the pickup unit and the swing member, and a guide hole to guide movement of the contact rod is arranged in an other one of the pickup unit and the swing member.

17. The image forming apparatus of claim 13, further comprising a housing that has an inner space to accommodate the pickup unit, and comprises an opening through which the pickup unit may pass and an upper cover to open or close the opening.

18. The image forming apparatus of claim 17, wherein the swing member and the elastic member are installed in the upper cover, and the rotation limiter is arranged in the upper cover.

19. An image forming apparatus comprising:

a paper feeding apparatus including:

a pickup unit including a pickup roller, and at least part of the pickup unit to rotate about a first axis and to move between a contact location at which the pickup roller contacts a recording medium and a separation location at which the pickup roller is separate from the recording medium, a swing member to rotate about a second axis, and to move the pickup unit from the contact location to the separation location by pressing the pickup unit, an elastic member to provide an elastic force to the swing member, so that the swing member rotates about the second axis, a rotation limiter to limit a rotation angle at which the swing member rotates; and a housing that has an inner space to accommodate the pickup unit, and comprises an opening through which the pickup unit may pass and an upper cover to open or close the opening, wherein a momentum of the swing member is less than a momentum of the pickup unit while the swing member presses the pickup unit and rotates, wherein the housing comprises a first joint and a second joint, the first joint and the second joint to support both ends of the pickup unit in a direction in which the first axis of the pickup unit extends, and at least one selected from the first joint and the second joint may be elastically deformed in the direction in which the first axis of the pickup unit extends.

20. The image forming apparatus of claim 17, wherein the housing is mounted in a main frame of the image forming apparatus, and the housing including a first portion having a fixed location that is fixed to the main frame of the image forming apparatus, and a second portion having a variable location that may be moved with respect to the main frame of the image forming apparatus.

* * * * *